United States Patent [19]

Raitto

[11] Patent Number: 4,475,367

[45] Date of Patent: Oct. 9, 1984

[54] KEY HOLDER

[76] Inventor: David A. Raitto, P.O. Box 125, 12 Maple St., Wheelwright, Mass. 01094

[21] Appl. No.: 358,673

[22] Filed: Mar. 16, 1982

[51] Int. Cl.[3] ..... A47G 29/10

[52] U.S. Cl. ..... 70/456 R

[58] Field of Search ..... 70/456–459; 7/167, 170; 24/3 K; 273/84 R; 150/40; D3/61, 62, 64; D22/1

[56] References Cited

U.S. PATENT DOCUMENTS

| | | | |
|---|---|---|---|
| D. 156,228 | 11/1949 | Gaudriot | D3/62 |
| D. 158,306 | 4/1950 | Modrey | D3/61 |
| D. 257,572 | 12/1980 | Wefler | D3/62 |
| 314,028 | 3/1885 | Jones | 70/456 R |
| 765,605 | 7/1904 | Wade | 273/84 R |
| 2,013,027 | 9/1935 | Branch | 70/456 R |

*Primary Examiner*—Robert L. Wolfe

*Attorney, Agent, or Firm*—Blodgett & Blodgett

[57] ABSTRACT

A key holder comprising an elongated cylindrical handle, having one or more annular ridges and a key retainer at one end of the handle for holding keys.

7 Claims, 11 Drawing Figures

KEY HOLDER

BACKGROUND OF THE INVENTION

This invention relates generally to a key holder and more specifically, a key holder which also functions as a self-defense weapon.

Key holders take a variety of forms. The function which all key holders have in common is to provide a structure which can be grasped by the fingers or hand and a retaining element for supporting one or more keys. Although most prior art key holders are affective in keeping all of the keys together, none of the key holders are immune to being lost or misplaced along with the keys which they hold. Also, none of the prior art key holders are affective as self-defense weapons. These and other difficulties experienced with the prior art devices have been obviated in a novel manner by the present invention.

It is, therefore, an outstanding object of the invention to provide a key holder which also functions as a very affective self-defense weapon.

Another object of the invention is the provision of a key holder which is unlikely to be lost or misplaced.

A further object of the present invention is the provision of a key holder which can be easily carried on the person of the user, even when clothing without pockets are worn.

It is another object of the instant invention to provide a key holder which is adapted to be carried at the waist-line of a person who is wearing almost any type of clothing.

A still further object of the invention is the provision of a key holder adapted to be carried on the person of the user in a manner in which the key holder is easily accessible both for use of the keys in their normal function and as a defense weapon.

It is a further object of the invention to provide a key holder which is adapted to be easily carried along the waist-line of the user, so that it is easily accessible by the user and yet is difficult to remove by another person without knowledge of the user.

It is a still further object of the invention to provide a key holder which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a key holder, comprising an elongated cylindrical handle having a generally smooth outer surface, an annular ridge extending from the outer surface and a key retainer at one end of the handle for holding keys.

Most specifically, the key holder has a plurality of spaced ridges extending from the outer surface of the handle and each ridge lies in the plane which is at a right angle to the central longitudinal axis of the handle.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
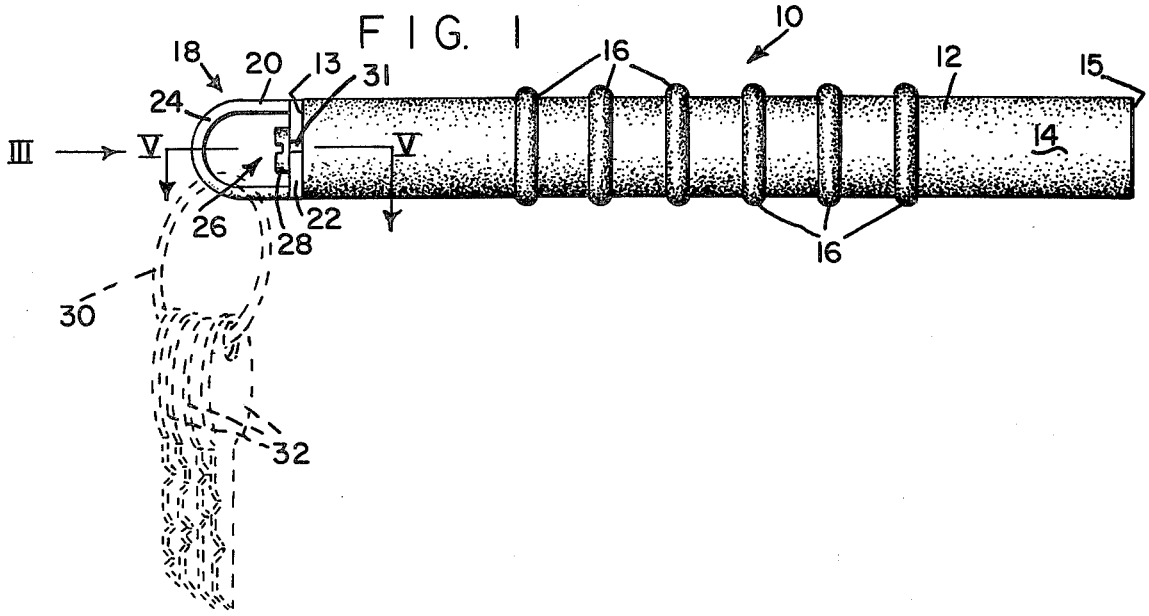
FIG. 1 is a side elevational view of the key holder embodying the principles of the present invention.
Figure 2:
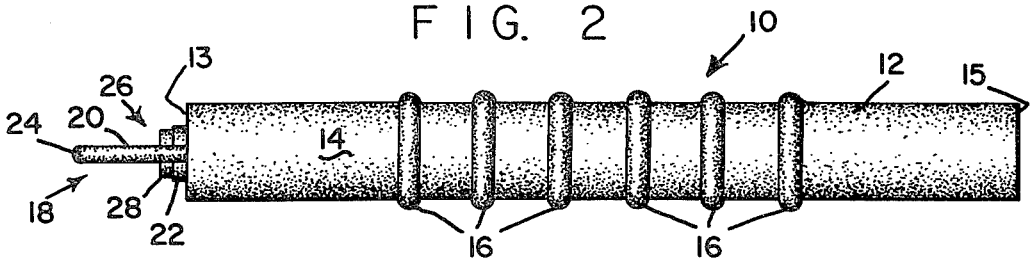
FIG. 2 is a plan view thereof.
Figure 3:
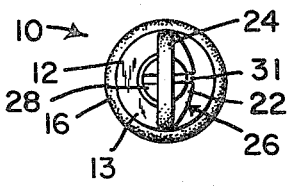
FIG. 3 is a front elevational view of the key holder looking in the direction of arrow III of FIG. 1.
Figure 4:
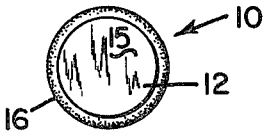
FIG. 4 is a rear elevational view of the key holder.
Figure 5:
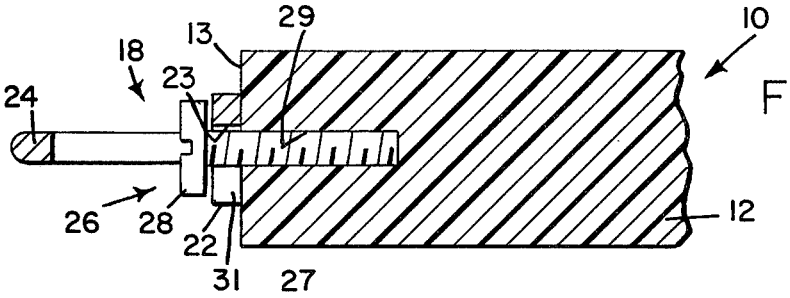
FIG. 5 is a fragmentary horizontal sectional view of the key holder, taken on the line V—V of FIG. 1.

Referring first to FIGS. 1 and 2, which best show the general features of the invention, the key holder of the present invention is generally indicated by the reference numeral 10 and comprises an elongated cylindrical handle 12, preferably made of thermoplastic material. The handle 12 has a smooth annular outer surface 14, a flat front end surface 13 and a flat rear end surface 15. The front and rear end surfaces 13 and 15, respectively, are each at a right angle to the central longitudinal axis of the handle 12. A plurality of spaced annular ridges 16 extend from the outer surface 14 of the handle. Each ridge 16 lies in a plane which is at a right angle to the central longitudinal axis of the handle.

A key retainer, generally indicated by the reference numeral 18 is attached to the front end of the handle 12 and includes a fixture 20 and a fastener generally indicated by the reference numeral 26. The fixture 20 includes a base portion 22 adapted to abut the front end surface 13 at the handle and a loop 24. The base 22 has an aperture 23. The fastener 26 is a screw consisting of a head portion 28 and a threaded shank portion 27 which extends through the aperture 23 of the base 22 and is threaded into a threaded hole 29 in the front end of the handle 12. If desired, the aperture 29 and the shank 27 can be smooth or the shank provided with ridges and forced into the hole 29. The head 28 is considerably larger than the aperture 23, so that the fixture 20 is securely restrained against the front end of the handle 12. However, there is sufficient clearance between the end of the handle 12 and the head 28, and between the shank portion 27 and the aperture 23, so that the fixture 20 is free to swivel about the shank portion 27.

The key retainer 18 is applied to the handle 12 by first screwing the fastener 26 in the hole 29. One side of the base portion 22 is provided with a slot 31 which is large enough to slip over the portion of the shank 27 which extends beyond the end surface 13. After the base portion 22 is inserted between the head portion 28 and the end surface 12, the base portion is crimped to close or narrow the slot 31. In this way, the key retainer 18 is loosely retained on the handle 12.

It is essential that the handle portion of the key holder be of a size which is small enough so as not to be uncomfortable or awkward to carry and yet, large enough to be effective as a self-defense weapon. Ideally, the length of the handle should be between 12 and 16 centimeters and the outer diameter, measured through the ridges, between 1.5 and 2.5 centimeters.

Figure 6:
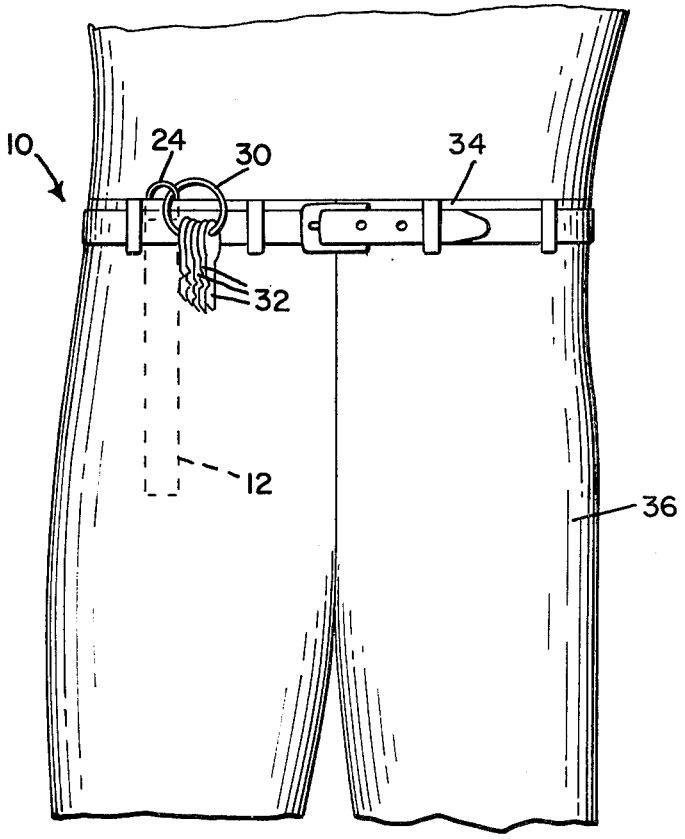
FIG. 6 is a diagrammatic view illustrating a typical manner in which the key holder can be carried.

The operation and advantages of the present invention will now be readily understood in view of the above description. As shown in FIG. 1, the loop 24 is adapted to receive a conventional key ring 30 of the type which can be separated for receiving a plurality of key 32. Although the key holder can be carried in a pocket or purse, it is particularly adapted to be carried about the waist of the user as illustrated in FIG. 6. The key holder and keys as a unit are looped over the top of the waist band 34 of a garment such as the trousers 36. The key holder and keys are carried so that the keys 32 extend outside of the trousers and the handle 12 extends inside of the trousers. In this way, the keys are readily accessible and the holder 12 is easily pulled out of the trousers by grasping the keys. The ridges 16 help to retain the holder in position at the waist and also ensures against theft of the keys by another person. Even if a professional pick-pocket with a light touch attempts to remove the keys, the ridges 16 will provide a sensory signal to the wearer. The wearer will feel the handle being removed due to the rubbing of the rib 16 along the waist band of the trousers and the wearer is also likely to hear the removal as well.

The ability of the key holder tend to be carried at the waist, as shown in FIG. 6, also enables it to be readily accessible for use as a self-defense weapon. The key holder is easily removed by grasping the keys. The size of the handle 12 is such, that it can be firmly and comfortably grasped in the users hand. The ridges 16 provide a firm grip and the length of the handle 12 is such that it extends forward and rearward of the users hand. In this way, the extending end of the handle can be used to generate a firm blow to an attacker without damage to the users hand. The key holder and keys can also be used as a flail weapon by grasping the handle 12 firmly and by snapping the wrist to cause the keys to swing about the loop 24 across the face of an attacker. The key holder and key combination can be made even more affective by adding a second ring to the key ring 30 and mounting additional keys on the second key ring.

FIRST MODIFIED KEY HOLDER

Figure 7:
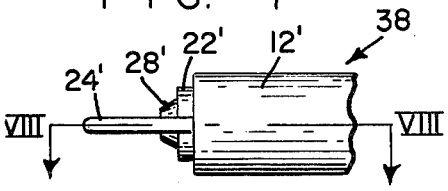
FIG. 7 is a fragmentary plan view of a first modified key holder.
Figure 8:
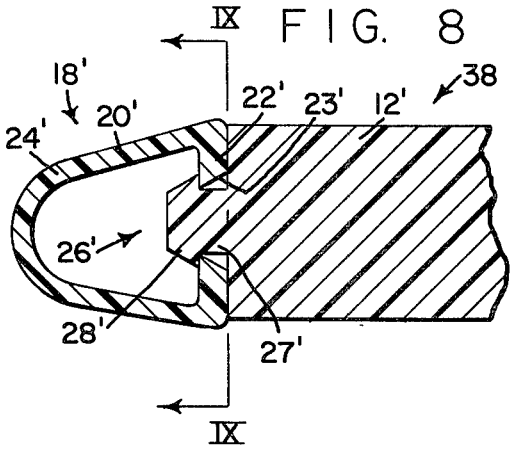
FIG. 8 is a vertical sectional view taken on the line VII—VII of FIG. 7.
Figure 9:
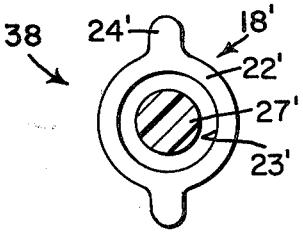
FIG. 9 is a vertical sectional view taken on the line IX—IX of FIG. 8, FIG. 10, is a fragmentary front elevational view of a second modified key holder.

Referring particularly to FIGS. 7–9, there is shown a first modified key holder, generally indicated by the reference numeral 38. The first modified key holder 38 includes a cylindrical handle 12' which is identified to handle 12, including the annular ridges 16.

Key holder 38 differs from key holder 10 in the construction of the key retainer which is generally indicated by the reference numeral 18' in FIGS. 7–9. The key retainer 18' comprises a fastener, generally indicated by the references numeral 26' and a fixture 20'. The fastener 20 is integral with the handle 12' and, consists of shank portion 27 and a head portion 28'. The fixture 20' consists of a base portion 22' having an aperture 23' and a loop 24'. The head portion 28' and the aperture 23' each have a frusto-conical shape as shown in section in FIG. 8. The fixture 20' is applied to the fastener 28' by forcing the heat 28' through the aperture 23'. Since the handle 12' is made of thermoplastic material there will be sufficient deflection of the head portion 28' to allow it be forced through the aperture 23'. The fixture 20 can be made of any material but it is preferred that it also be made of a thermoplastic material.

SECOND MODIFIED KEY HOLDER

Figure 10:
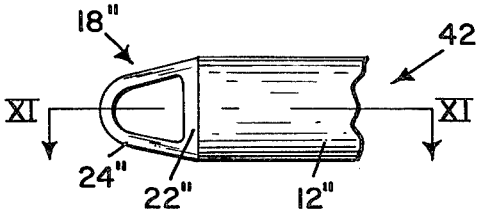
Figure 11:
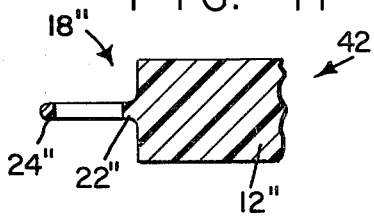
FIG. 11 is a horizontal sectional view taken on the line XI—XI of FIG. 10.

Referring to FIGS. 10 and 11, there is shown a second modified key holder, generally indicated by the reference numeral 42. The second modified key holder 42 includes a handle 12" which is idential to handle 12, including the annular ridges 16. The key holder 42 comprises a key retainer 18" which is integral with the handle 12" and includes a base portion 22" and a loop portion 24".

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Key holder comprising:

(a) an elongated cylindrical handle having a generally smooth outer surface, (b) an annular ridge extending from said outer surface, and (c) a key retainer at one end of the handle for holding keys, said key retainer comprising:

(1) a fixture consisting of a base with an aperture and a loop extending from the base, and (2) a fastener consisting of a shank portion, one end of which is fixed to said one end of the handle and extending through said aperture, and a head portion at the opposite end of the shank portion, said head portion being adapted for retaining the fixture on the handle.

2. Key holder as recited in claim 1, wherein there is a threaded hole at said one end of the handle and the fastener is a screw which is threaded into the hole.

3. Key holder as recited in claim 1, wherein the fastener is integral with the handle, the head portion of the fastener and the aperture of the base each being frusto-conical in shape with the base of the cone facing said one end of the handle so that the fixture is applied to the fastener by forcing the head through the aperture in a snap fit.

4. Key holder as recited in claim 3, wherein the handle and key retainer are made of thermoplastic material.

5. Key holder as recited in claim 1, wherein there are a plurality of said ridges extending from said surface at spaced intervals.

6. Key holder as recited in claim 1, wherein the ridge lies in a plane which is at a right angle to the central longitudinal axis of the handle.

7. Key holder as recited in claim 1, wherein the opposite end of the handle has a flat end surface which is at a right angle to said outer surface.

* * * * *